US005345702A

United States Patent [19]

Hughes

[11] Patent Number: 5,345,702

[45] Date of Patent: Sep. 13, 1994

[54] REMOVABLE PIPE ARCH FOR DRAGLINE BUCKETS

[75] Inventor: James T. Hughes, Mt. Vernon, Ohio

[73] Assignee: Indresco Inc., Dallas, Tex.

[21] Appl. No.: 928,279

[22] Filed: Aug. 11, 1992

[51] Int. Cl.[5] ..... E02F 3/00

[52] U.S. Cl. ..... 37/399; 37/394

[58] Field of Search ..... 37/399, 398, 397, 396, 37/395, 394

[56] References Cited

U.S. PATENT DOCUMENTS

| | | | |
|---|---|---|---|
| 882,726 | 3/1908 | Weeks . | |
| 1,000,258 | 8/1911 | Greenlee . | |
| 1,508,639 | 9/1924 | Beach et al. . | |
| 2,455,160 | 11/1948 | Burrow . | |
| 2,588,657 | 3/1952 | Pitts . | |
| 2,796,283 | 6/1957 | Grazier | 37/399 |
| 2,869,843 | 1/1959 | Bleaney . | |
| 4,295,287 | 10/1981 | Natzke et al. . | |
| 4,692,089 | 9/1987 | Rodgers et al. . | |
| 4,791,738 | 12/1988 | Briscoe | 37/399 |
| 4,944,102 | 7/1990 | Behlendorf et al. . | |

FOREIGN PATENT DOCUMENTS 3324836 1/1985 Fed. Rep. of Germany .

*Primary Examiner*—Randolph A. Reese
*Assistant Examiner*—Spencer Warnick
*Attorney, Agent, or Firm*—Johnson & Wortley

[57] ABSTRACT

A dragline bucket having a back wall, opposite side walls, a bottom, an open front, and a removable pipe arch assembly for connecting the front upper corners of the side walls of the bucket together, the removable pipe arch assembly including a saddle bracket on the inside upper front corner of each of the side walls of the bucket, the saddle bracket having a semi-annular channel providing a pocket on the inside face of each saddle bracket, a pipe arch extending between the saddle brackets, the opposite ends of the pipe arch being removably engaged in the saddle bracket on each of the side walls, a collar on each end portion of the pipe arch resting in the pocket in each of the saddle brackets, and a locking plate connected with each of the saddle brackets over the pipe for removably locking the pipe end portions in the saddle brackets. In event of damage to the pipe arch, the locking plates may be removed from the saddle brackets, the pipe arch with the end collars lifted from the saddle bracket and replaced and the locking plates reconnected with the saddle brackets.

6 Claims, 3 Drawing Sheets

REMOVABLE PIPE ARCH FOR DRAGLINE BUCKETS

BACKGROUND OF THE INVENTION (1) Field of the Invention

This invention relates to dragline buckets and more particularly relates to a removable pipe arch for dragline buckets.

(2) History of the Prior Art

A dragline is an excavating machine which includes a bucket connected with hoist, drag, and dump lines and drawn toward the machine in an excavating step during which the bucket is filled with the material being excavated. Dragline buckets are capable of operating with a predetermined gross suspended load which consists of hardware comprising the bucket structure, the various support and operating lines, and related apparatus, and the payload of material being removed. Any weight which can be eliminated from the hardware may be added to the payload without affecting the gross suspended load being handled by the dragline. Conventional dragline buckets, as illustrated in FIGS. 1 and 2 of the drawings, include a somewhat massive box shaped full clearance arch connected over and between opposite sides of the front of the bucket serving as both a brace and to attach dump ropes to the bucket. The full clearance arch adds substantial weight to the bucket as well as providing unobstructed entry of material into the bucket as the bucket is dragged toward the dragline machine.

One alternative prior art bucket design which reduces the significant weight of the full clearance type bucket arch is the fixed straight through pipe arch illustrated in FIG. 3. While the pipe arch design reduces the hardware weight and significantly increases the payload which can be handled by the bucket, the free flow of material into and out of the bucket is more restricted than with the full clearance arch. In overburden stripping applications having poorly fragmented, large, blocky material, the fixed straight through pipe arch style bucket is often not a feasible means of minimizing bucket weight to increase the effective payload of the bucket. Due to the location and the smaller size of the pipe arch relative to the full clearance arch, the pipe arch is extremely susceptible to damage from material entering or exiting the bucket. The net dragline production increases effected through greater payloads using a pipe arch bucket are often lost due to machine downtime for repairing or replacing damaged arches.

The weight reducing advantages of the pipe arch type dragline bucket are inherent in the present invention with the further advantage of reduced downtime for repairing or replacing the pipe arch.

SUMMARY OF THE INVENTION

It is an object of the present invention to provide a new and improved dragline bucket.

It is another object of the invention to provide a new and improved dragline bucket utilizing a straight through pipe arch.

It is a still further object of the invention to provide a removable pipe arch for a dragline bucket.

In accordance with the invention, there is provided a removable straight through pipe arch for a dragline bucket which includes a saddle type bracket inside each front upper corner of the bucket sides and a removable pipe arch assembly including a pipe having collars on opposite ends received in the saddle bracket and held in place by a locking plate secured in the saddle bracket over the pipe.

BRIEF DESCRIPTION OF THE DRAWINGS

The foregoing objects and advantages of the invention together with specific preferred embodiments thereof will be better understood from the following detailed description taken in conjunction with the accompanying drawings, wherein.

DETAILED DESCRIPTION

Figure 1:
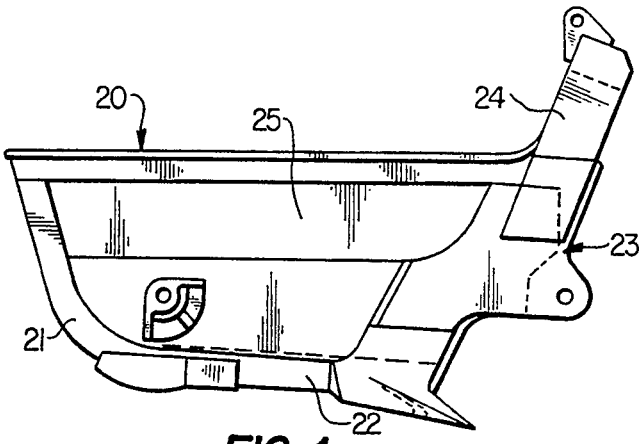
FIG. 1 (PRIOR ART)
FIG. 1 is a side view in elevation of a conventional prior art dragline bucket having a full clearance type bucket arch.
Figure 2:
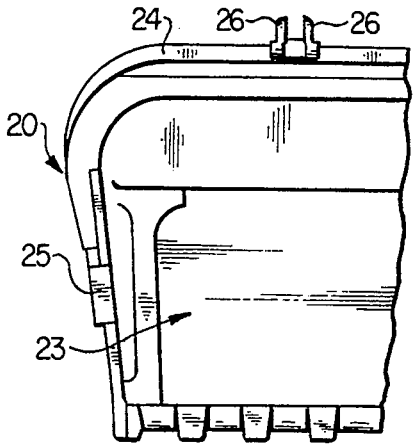
FIG. 2 (PRIOR ART)
FIG. 2 is a fragmentary back view in elevation of the prior art bucket of FIG. 1.
Figure 3:
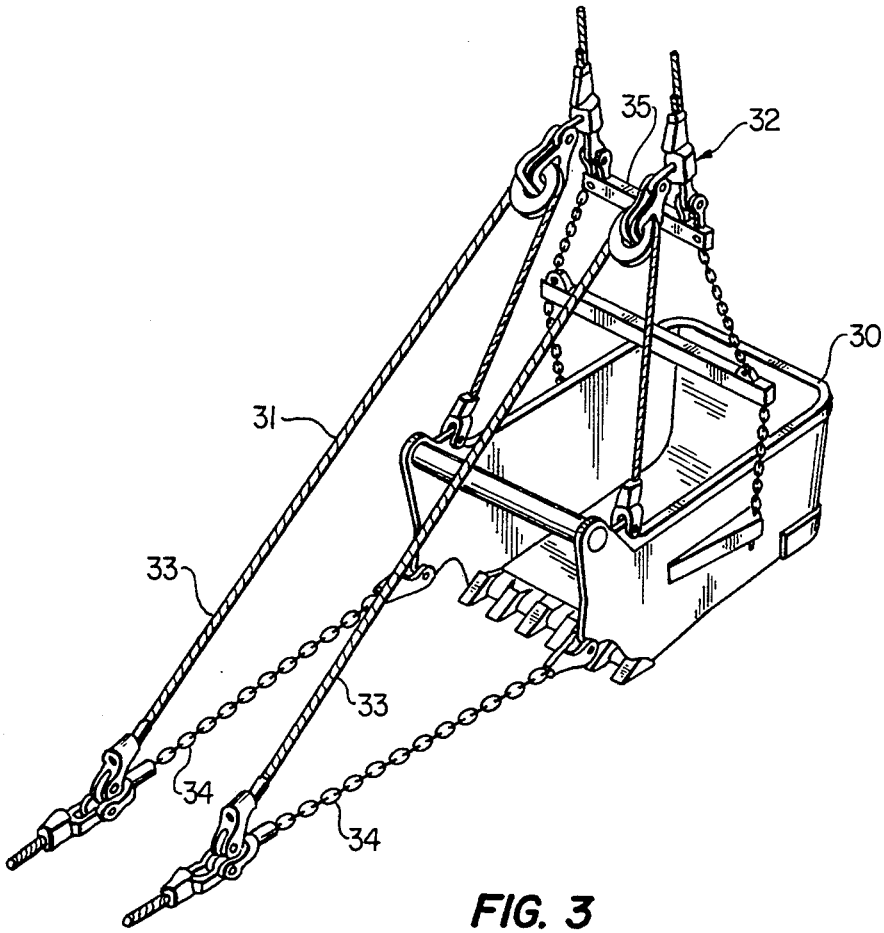
FIG. 3 (PRIOR ART)
FIG. 3 is a view in perspective of a prior art dragline bucket having a fixed straight through pipe arch and including bucket supporting and operating rigging.
Figure 4:
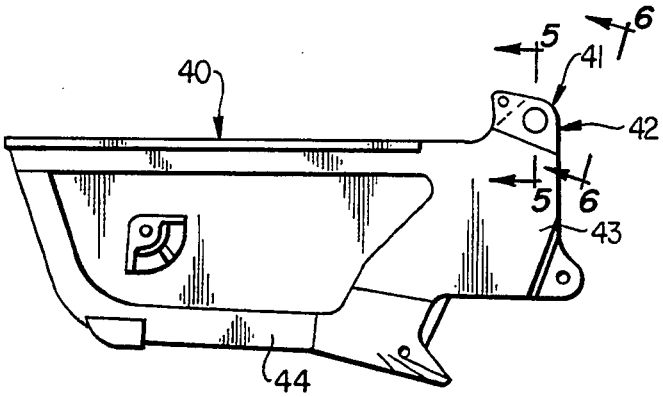
FIG. 4 is a side view in elevation of a dragline bucket having a removable pipe arch in accordance with the invention.

For purposes of better understanding the structural details and advantages of the present invention, reference is made to FIGS. 1–3 illustrating prior art dragline buckets. Referring to FIGS. 1 and 2, a prior art dragline bucket 20 has a back 21, a bottom 22, and an open front 23 where material handled by the bucket enters and leaves the bucket. The bucket 20 has a full clearance box section arch 24 connected between the opposite upper front corners of the sides 25 of the bucket providing bracing between the sides and providing for connection of the front of the bucket to dump ropes 26 from a dragline machine, not shown. While the full clearance arch 24 provides a maximum opening for the movement of material into and out of the bucket, the arch is quite heavy, and thus, reduces the effective net payload which can be handled by the bucket.

Referring to FIG. 3, another form of prior art dragline bucket 30 utilizes a fixed straight through pipe arch 31 secured with the upper front corners of the bucket sides. The bucket 30 is supported from and operated by rigging 32 which includes dump ropes 33 connected to the upper front corners of the sides of the bucket 30 adjacent to the fixed connections of the pipe arch 31 into the bucket sides. The rigging 32 also includes drag ropes 34 connected to the lower front corners of the bucket 30 and a harness 35 which connects to the opposite sides of the bucket between the front and rear of the bucket for supporting the bucket when picking up, moving, and dumping material. While the pipe arch 31 substantially reduces the weight of the bucket 30 and increases the net payload handled by the bucket, the pipe arch also reduces the space available for flow of material into and out of the bucket and is more readily damaged by the material than is the arch 24 of the bucket 20. When the fixed pipe arch 31 is damaged sufficiently to require replacement, the dragline downtime can be lengthy and expensive.

FIGS. 4–9 illustrate a dragline bucket including a removable pipe arch assembly 41 incorporating the features of the invention. The removable pipe arch assembly 41 is mounted on the upper front corners of the sides of the dragline bucket 40. The specific structural details of the removable pipe arch assembly 41 are illustrated in FIGS. 5–9D. The opposite ends of the pipe arch assembly 41 includes a saddle type bracket 42. The two saddle brackets 42 are secured by welding to the upper front corner of the sides 43 of the bucket 40, as evident in FIG. 4. The two opposite front sides 43 of the bucket 40 along with the bottom 44 of the bucket define the front open end of the bucket.

Figure 9A:
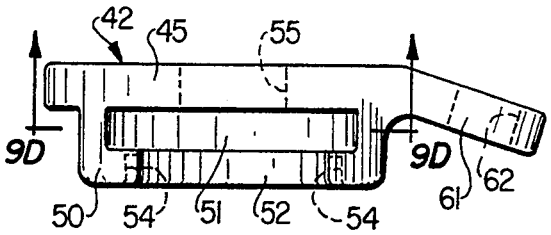
FIG. 9A is a top view of the saddle bracket of the invention taken along the line 9A—9A of FIG. 9.
Figure 9B:
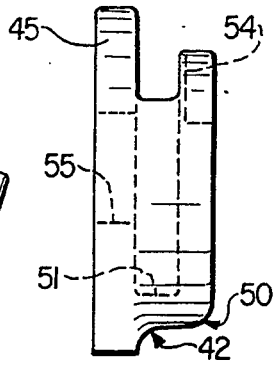
FIG. 9B is a side view in elevation of the saddle bracket taken along the line 9B—9B of FIG. 9.
Figure 9C:
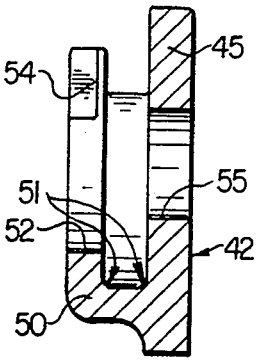
FIG. 9C is a view in section of the saddle bracket taken along the line 9C—9C of FIG. 9.
Figure 9D:
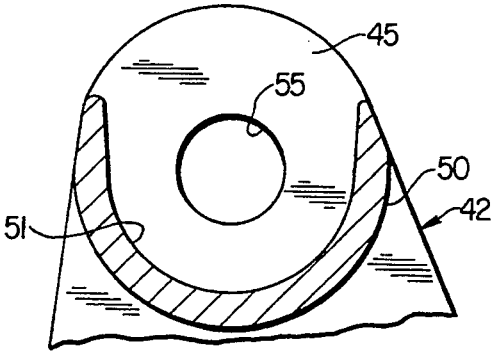
FIG. 9D is a view in section in elevation of the saddle bracket taken along the line 9D—9D of FIG. 9A.
Figure 9:
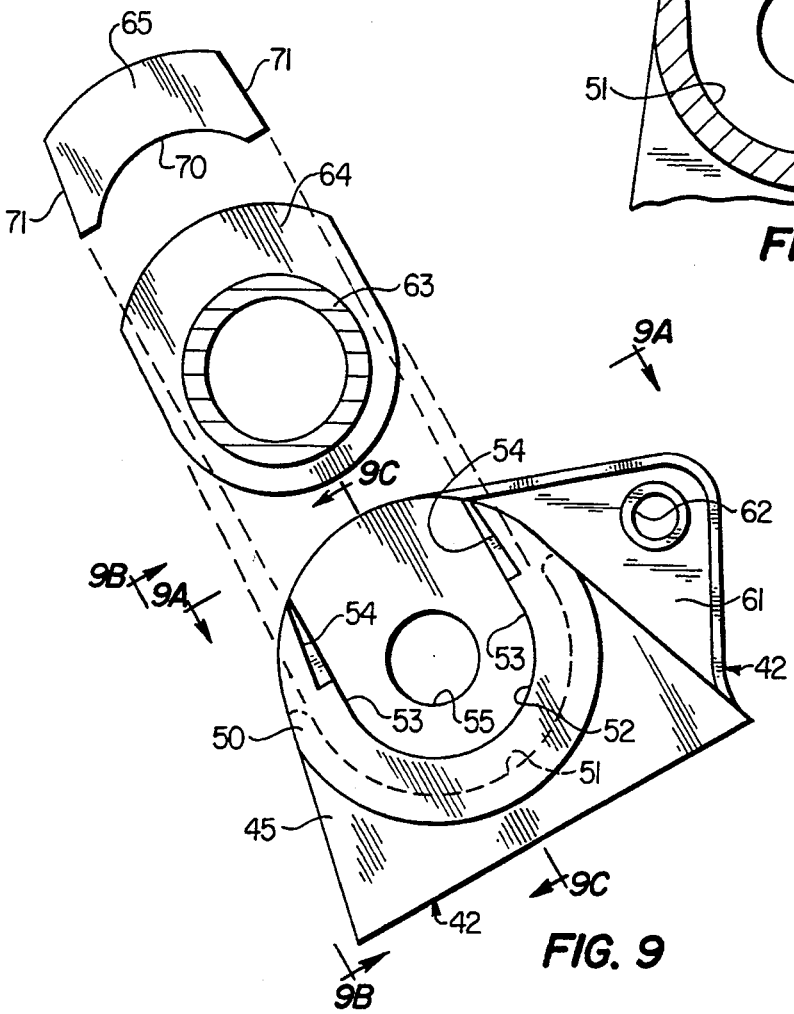
FIG. 9 is a fragmentary exploded view in section and elevation showing component parts of the pipe arch assembly and the saddle bracket illustrated in FIG. 5 as viewed along the line 7—7.
Figure 8:
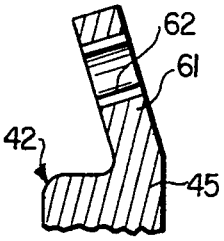
FIG. 8 is a fragmentary view in section along the line 8—8 of FIG. 7 showing a dump rope connection fitting on one side of the dragline bucket.

The saddle bracket 42 is preferably a metal casting having an outside plate portion 45 and an integral inner semi-annular channel portion 50. The channel portion 50 extends in circular array about 270 degrees defining an upwardly opening pocket 51. The channel portion 50 of the saddle bracket as best seen in FIG. 9, is circular in shape around approximately the lower half 52 with the opposite sides 53 being somewhat flared outwardly and substantially straight terminating in wedge shaped locking notches 54 along opposite sides which define a wedge shaped upper end opening or mouth for the installation of a wedge type locking plate, described hereinafter, for holding the removable pipe arch in place. The outer plate portion 45 of the saddle bracket has a round opening 55 covered by a closure plate 60 secured to the outer surface of the outer plate. Each of the saddle brackets 42 has an integral dump rope connector 61 formed along the back of the saddle bracket 42 as seen i n FIGS. 7–9. The connector 61 has a hole 62 for securing an end of a dump rope in the manner represented in FIG. 3.

In accordance with the invention, the pipe arch assembly 41 includes a straight through pipe arch 63 removably supported at opposite ends by the saddle brackets 42 secured on the upper front portions of the sides 43 of the bucket 40. Each of the opposite ends of the pipe arch is fitted with an eccentric collar 64. The collars 64 are each welded along the opposite ends of the pipe arch in planes perpendicular to the longitudinal axis of the pipe arch. The opposite end portions of the pipe arch are supported by the saddle bracket channel portion 50 in the opening 52 with the collars 64 fitting in the pockets 51 defined by the saddle bracket channels. The pipe arch is held in each saddle bracket by a wedge type locking plate 65. The locking plate is a circular segment having a circular arc shaped convex lower edge 70 which fits over a portion of the top surface of the ends of the pipe arch 63 retaining the pipe arch in the saddle brackets. The locking plate has opposite side edges 71 which converge in a direction away from the edge 70 providing wedge shaped edges to the locking plate sloped to fit the wedge shaped recesses 54 along the mouth or opening into the saddle bracket retainer channel portion 50.

Figure 6:
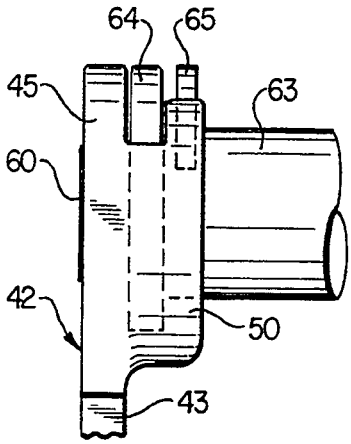
FIG. 6 is a fragmentary front view in elevation along the line 6—6 of FIG. 4 showing the connection of one end of the pipe arch assembly as shown in FIG. 5 with the near side of the dragline bucket as shown in FIG. 4.
Figure 5:
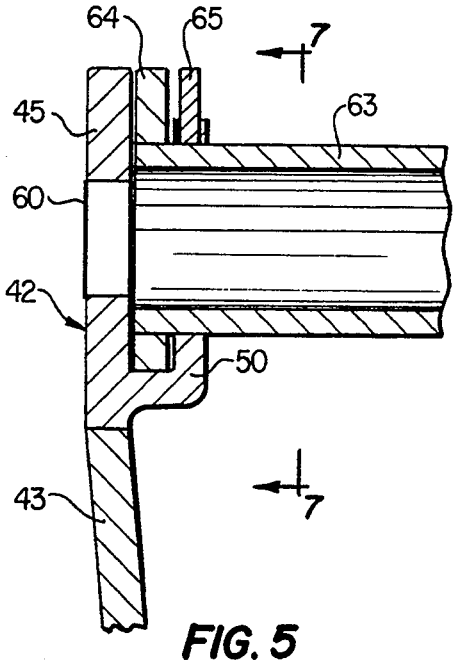
FIG. 5 is a enlarged fragmentary view in section along the line 5—5 of FIG. 4 showing the connection of one end of a pipe arch assembly in accordance with the invention with the near side of the dragline bucket as illustrated in FIG. 4.
Figure 7:
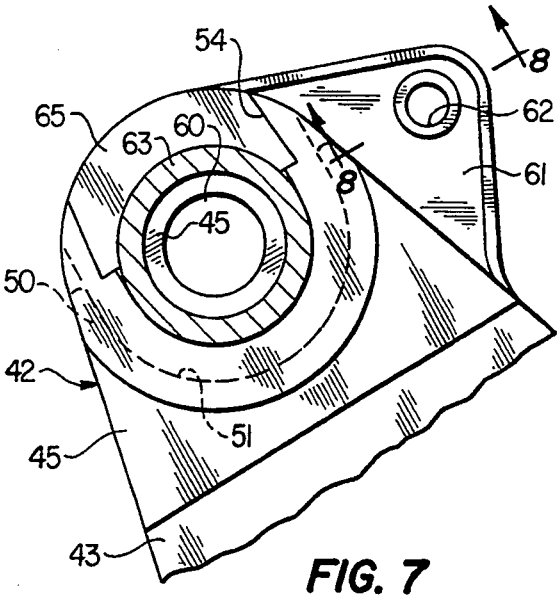
FIG. 7 is a fragmentary view in section and elevation along the line 7—7 of FIG. 5.

The pipe arch 63 is installed on the dragline bucket by placing the pipe arch between the saddle brackets 42 and positioning the eccentric collars 64 at the ends of the pipe arch in the arcuate pockets 51 of the channel portion 50 of each saddle bracket. FIGS. 5–7 illustrate one end the pipe arch in position with a collar 64 resting in a saddle bracket channel portion 50. At each saddle bracket the locking plate 65 is installed above the pipe arch in the wedge shaped mouth of the saddle bracket channel portion 50 engaging the edges 71 of each locking plate in the saddle bracket locking notches 54. After each locking plate 65 is positioned within the mouth of the saddle bracket channel 50, the locking plate is wedged tightly in place above the pipe arch by urging the locking plate away from the pipe arch to tightly engage the locking plate edges 71 with the saddle bracket notch edges. The locking plate is then welded in place along the juncture of the locking plate edges 71 with the saddle bracket channel portion edges. The locking plates 65 as welded in position in each of the saddle brackets holds the pipe arch 63 in position providing bracing across the front of the bucket between the bucket side plates.

The bucket is connected with a dragline, not shown, in the relationship illustrated in FIG. 3 with dump ropes 33 and the pull chains or ropes 34 connected with the bucket as illustrated. The dump ropes are secured with the dump rope anchors 61 through the holes 62 on the saddle brackets. The bucket is then operated in the normal manner pulling the bucket toward the dragline machine, not shown, with excavated material entering the open front end of the bucket beneath and sometimes above and around the pipe arch 63, depending upon the quantity and fragment size of the material being excavated. During the excavation operation the removed material may damage the pipe arch 63. If damaged sufficiently to require replacement, the locking plates 65 are removed from the saddle brackets 42 at each end of the pipe arch and the pipe arch along with the collars 64 on the pipe arch ends is lifted from the saddle brackets and replaced with a new pipe arch with eccentric collars. The locking plates 65 are then reins tailed as previously described.

It will now be seen that a new and improved dragline bucket and removable dragline pipe arch have been described and illustrated. The pipe arch is readily installed and removed reducing the downtime of the dragline in the event of damage to the pipe arch. The use of the relatively light removable pipe arch assembly of the invention increases the effective payload of material which may be removed by the dragline bucket in contrast with operation of dragline buckets utilizing the conventional box shaped full clearance arch.

It will be recognized that while a specific preferred embodiment of a removable dragline pipe arch and mounting structure for securing the pipe arch to a dragline bucket side plates has been described and illustrated, other forms of specific structure for mounting the pipe arch on the dragline bucket side plates may be made without departing from the spirit and scope of the invention as defined in the following claims.

What is claimed is:

1. A dragline bucket having a back wall, opposite side walls, a bottom and an open front, further comprising:

(a) saddle bracket on each of said opposite side walls positioned toward said open front and spaced above said bottom for removably connecting a tubular member between said side walls;

(b) a tubular member comprising a straight pipe extending between said saddle brackets removably connected with said opposite side walls along a line spaced from said bottom;

(c) a collar on each of opposite ends of said tubular member engageable with and removably securing said tubular member with said saddle brackets on said opposite side walls; and (d) each said saddle bracket includes an internal channel portion providing a semi-annular pocket for said collar on said said pipe and a wedge member engageable with each said channel portion for locking said pipe in said channel portion and said collar in said pocket.

2. A dragline bucket in accordance with claim 1 where said collar on each end of said pipe is an eccentric shaped plate shaped to fit in said pocket of said channel portion on said saddle bracket.

3. A dragline bucket in accordance with claim 2 where said eccentric shaped plate on opposite ends of said pipe comprises an annular portion of substantially uniform width extending around substantially one half of said pipe and an outwardly flared arcuate wedge portion around the other half of said pipe and said pocket in said channel portion of said saddle bracket is shaped to conform with and receive said eccentric shaped collar.

4. A dragline bucket in accordance with claim 3 where said channel portion on said saddle bracket is defined by a semi-annular flange shaped to support substantially half of an end portion of said pipe and said flange having a wedge shaped mouth having locking notches opposite said circular portion to receive said wedge member for holding said pipe in said saddle bracket.

5. A dragline bucket comprising:

(a) a back wall;

(b) a bottom wall;

(c) opposite side walls connected with said back wall and said bottom wall;

(d) an open front defined by said bottom and side walls;

(e) a saddle bracket on an upper front corner of each of said side walls at said front of said bucket, said saddle bracket having an outer plate portion and an inner flange portion spaced from said outer plate portion defining a semi-annular channel providing a pocket on said saddle bracket along the inner face of said outer plate portion, said pocket opening upwardly and said flange having an upwardly opening wedge shaped mouth and a lower circular portion for supporting an end portion of a pipe, said saddle bracket being adapted to removably connect an end portion of a pipe with an upper front corner of an inside face of each said side wall of said bucket;

(f) a pipe extending between said saddle brackets for coupling said upper front corners of said sides of said bucket together, opposite end portions of said pipe resting in said semi-annular portion of said flange on the inside of each of said saddle brackets;

(g) an eccentric shaped collar on each opposite end portion of said pipe shaped to fit in said pocket of each of said saddle brackets whereby said pipe end portions are removably supported by said saddle brackets; and (h) a wedge shaped locking plate having an arc shaped concave lower edge surface shaped to conform to the convex shape of the outer surface of said pipe, said locking plate being engaged in said wedge shaped mouth of said saddle bracket inner flange for holding said pipe in said saddle bracket and said collar on said pipe in said pocket of said saddle bracket.

6. A removable pipe arch for connecting upper front corners of opposite side walls of a dragline bucket together along a line spaced from a bottom of said bucket at a front end of said bucket, said removable pipe arch comprising:

(a) a saddle bracket on an upper front corner of each of said side walls at said front of said bucket, said saddle bracket having an outer plate portion and an inner flange portion spaced from said outer plate portion defining a semi-annular channel providing a pocket in said saddle bracket along the inner face of said outer plate portion, said pocket opening upwardly and said flange having an upwardly opening wedge shaped mouth having locking notches and a lower circular portion for supporting an end portion of a pipe, said saddle bracket being adapted to removably connect an end portion of a pipe with an upper front corner of an inside face of each said side wall of said bucket;

(b) a pipe extending between said saddle brackets for coupling said upper front corners of said sides of said bucket together, opposite end portions of said pipe resting in said lower circular portion of said flange on the inside of each of said saddle brackets;

(c) an eccentric shaped collar on opposite end portions of said pipe shaped to fit in said pocket of each of said saddle brackets whereby said pipe end portions are removably supported by said saddle brackets; and (d) a wedge shaped locking plate having an arc shaped concave lower edge surface shaped to conform to the convex shape of the outer surface of said pipe, said locking plate being engaged in said wedge shaped mouth of said saddle bracket inner flange for holding said pipe in said saddle bracket and said collar on said pipe in said pocket defined in said saddle bracket.

* * * * *

UNITED STATES PATENT AND TRADEMARK OFFICE

CERTIFICATE OF CORRECTION

PATENT NO. : 5,345,702

DATED : September 13, 1994

INVENTOR(S) : James T. Hughes

It is certified that error appears in the above-indentified patent and that said Letters Patent is hereby corrected as shown below:

Column 3, line 51: Delete "i n"; insert --in--

Column 4, line 51: Delete "reins tailed"; insert --reinstalled--

Signed and Sealed this

Eleventh Day of April, 1995

*Attest:*

Bruce Lehman

BRUCE LEHMAN

*Attesting Officer*

*Commissioner of Patents and Trademarks*